US005815986A

United States Patent [19]

Laska

[11] Patent Number: 5,815,986

[45] Date of Patent: Oct. 6, 1998

[54] MASONRY END DAM

[76] Inventor: Walter A. Laska, 2000 Aldrich Pl., Downers Grove, Ill. 60516

[21] Appl. No.: 589,096

[22] Filed: Jan. 23, 1996

[51] Int. Cl.[6] ..... F04B 1/70

[52] U.S. Cl. ..... 52/62; 52/61; 52/204.2; 52/302.6

[58] Field of Search ..... 52/58, 60, 61, 52/62, 204.2, 210, 302.6

[56] References Cited

U.S. PATENT DOCUMENTS

| | | | |
|---|---|---|---|
| 2,095,072 | 10/1937 | Ludden | 52/302.6 X |
| 2,245,965 | 4/1941 | Cunin | 52/204.2 X |
| 2,541,768 | 2/1951 | Keller | 52/287.1 |
| 2,699,058 | 1/1955 | Ehrenberg | 52/302.6 |
| 3,199,256 | 8/1965 | Considder | 52/60 X |
| 4,068,023 | 1/1978 | Nielsen et al. | 427/138 |
| 4,103,061 | 7/1978 | Chomes | 428/247 |
| 4,186,531 | 2/1980 | Okilischan | 52/58 X |
| 4,202,143 | 5/1980 | Mear et al. | 52/204.2 X |
| 4,280,308 | 7/1981 | Svensson | 52/204.2 X |
| 4,700,512 | 10/1987 | Laska | 52/58 |
| 4,706,427 | 11/1987 | Zeilinger | 52/287.1 |
| 5,027,572 | 7/1991 | Purcell et al. | 52/309.9 |
| 5,072,552 | 12/1991 | Sauder | 52/62 X |
| 5,077,943 | 1/1992 | McGady | 52/58 |
| 5,115,614 | 5/1992 | McGrath | 52/169.5 |
| 5,154,029 | 10/1992 | Sturgeon | 52/61 X |
| 5,274,968 | 1/1994 | Pardo | 52/97 |
| 5,333,419 | 8/1994 | Hickner | 52/62 X |
| 5,349,792 | 9/1994 | Bayes | 52/62 |

FOREIGN PATENT DOCUMENTS

| | | | |
|---|---|---|---|
| 528771 | 2/1993 | European Pat. Off. | 52/58 |
| 2951275 | 7/1981 | Germany | 52/58 |
| 2212831 | 8/1989 | United Kingdom | 52/58 |

OTHER PUBLICATIONS

Lead Development Association, "Lead Flashings, Weatherings, and Roofings", p. 25, 1958.

*Primary Examiner*—Michael Safavi
*Attorney, Agent, or Firm*—Welsh & Katz, Ltd.

[57] ABSTRACT

An end dam for a masonry wall comprising three orthogonal rectilinear planar structures each joined, at a common corner and two adjacent sides, and an adhesive disposed along an outer surface of at least one of the three planar structures. The end dam being used along either end of a flashing lying along the outer surface of a lintel within an opening in a wall structure so as to allow for continuous drainage of moisture flowing downward within a drainage space of the wall structure.

3 Claims, 2 Drawing Sheets

FIG. 3
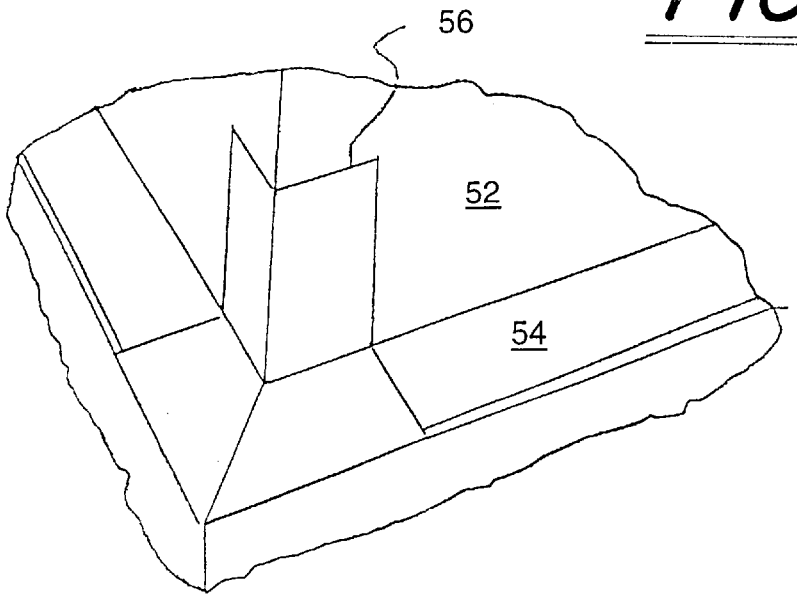
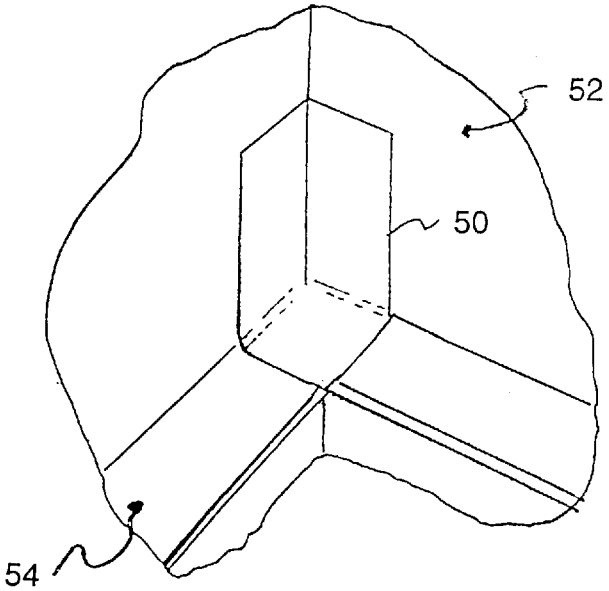
FIG. 4

MASONRY END DAM

FIELD OF THE INVENTION

The field of the invention relates to masonry structures and in particular to end dams used to facilitate water drainage from an interior of it brick wall to an exterior.

BACKGROUND OF THE INVENTION

Wall systems having a masonry exterior are typically constructed of at least one vertical layer of masonry and at least a second vertical layer of a material forming a back-up system. The back-up system nay be constructed of lumber or of a concrete masonry unit. The brick and back-up system are typically bonded together by horizontal metallic ties spaced 16 inches in a vertical plane. A space is often provided in such wall systems (e.g., cavity wall systems) between the brick and back-up system for moisture drainage. Insulation may also be placed in the space to improve the energy efficiency of masonry buildings.

Masonry offers great durability and appeal. Masonry walls, however, tend to be permeable, allowing water to pass through the wall under certain conditions, such as storms associated with high winds. Where water penetration is extensive, the wall may become saturated.

Where saturation of a masonry wall does occur, the result is often corrosion of metal reinforcing and support structures. Where the saturation is extensive, water may also enter and saturate the insulation causing the insulation to lose its effectiveness. In cold climates, water trapped within the wall may freeze. As the water freezes, the expansion of the water into ice may cause dimensional changes in the masonry wall. Over repeating cycles of freezing and thawing, the masonry wall may be subject to cracking, crazing, spalling, and disintegration. Efflorescence may appear on exterior surfaces. The penetration of water through the walls to the interior may cause interior finishes to deteriorate.

Flashing, in general, is a membrane installed within a masonry wall that collects water that has penetrated the exterior surface and facilitates its drainage back to the exterior. Corner flashing membranes for building foundations, or the like, are known. Such membranes are typically constructed of two vertical, right-angle surfaces joining a horizontal plate at a top and a bottom. Such membranes are important for the control of water saturation of masonry walls.

While such flashing is effective in draining water out of walls, its use has been limited to the interior and exterior corners of masonry buildings. Because of the importance of masonry structures in general, a need exists for a method of ensuring water drainage from around doors and windows of brick walls.

Accordingly, it is an object of this invention to provide a drainage structure adaptable to doors and windows that provides an effective drainage path from an interior of a masonry wall to the exterior.

It is a further objective of the invention to provide a drainage structure which is simple to construct and easy to use for the retrofit of old walls or in new construction.

SUMMARY OF THE INVENTION

An end dam for a masonry wall comprising three orthogonal rectilinear planar structures each joined, at a common corner and two adjacent sides, and an adhesive disposed along an outer surface of at least one of the three planar structures.

BRIEF DESCRIPTION OF THE DRAWINGS

FIG. 3 is a perspective view of an outside corner flashing having a similar functionality to the end dam of FIG. 1; and FIG. 4 is a perspective view of an inside flashing having a similar functionality to the end dam of FIG. 3.

DETAILED DESCRIPTION OF A PREFERRED EMBODIMENT

Figure 1:
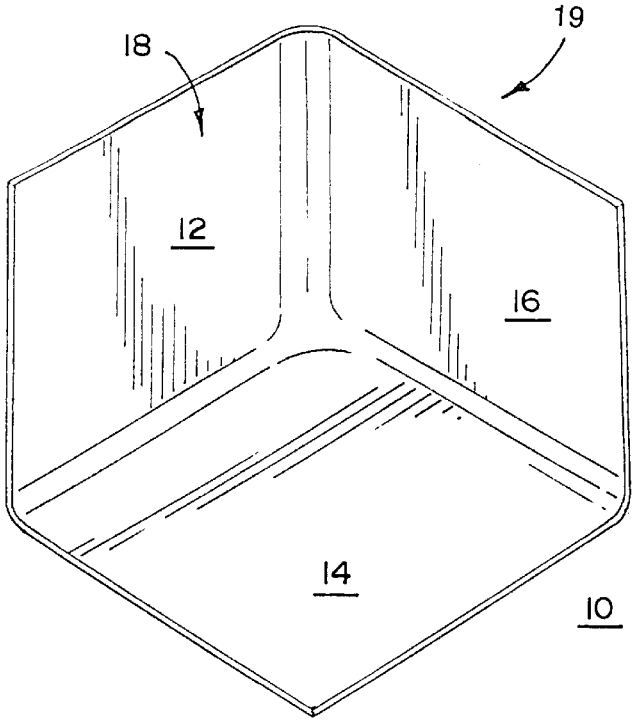
FIG. 1 is a perspective view of an end dam in accordance with an embodiment of the invention.

FIG. 1 is a perspective view of an end dam 10, generally, in accordance with an embodiment of the invention. The end dam 10 is constructed of three rectilinear planar structures 12, 14, 16, each joined one to another at a common corner and two adjacent sides. The three structures 12, 14, 16 are each oriented at right angles to each other along each common edge. The end dam 10 has an inner surface 18 and an outer surface 19. The inner surfaces 18 can generally be defined as a composite of the three surfaces on a common side of the structures 12, 14, 16 of the end dam 10 which each form a ninety degree angle with any adjoining surface. Likewise, an outer surface is made up of the three surfaces which forms a two hundred and seventy degree angle with an adjoining surface. During use an adhesive is generally applied to at least two of the three sides of the outer surface 19.

Figure 2:
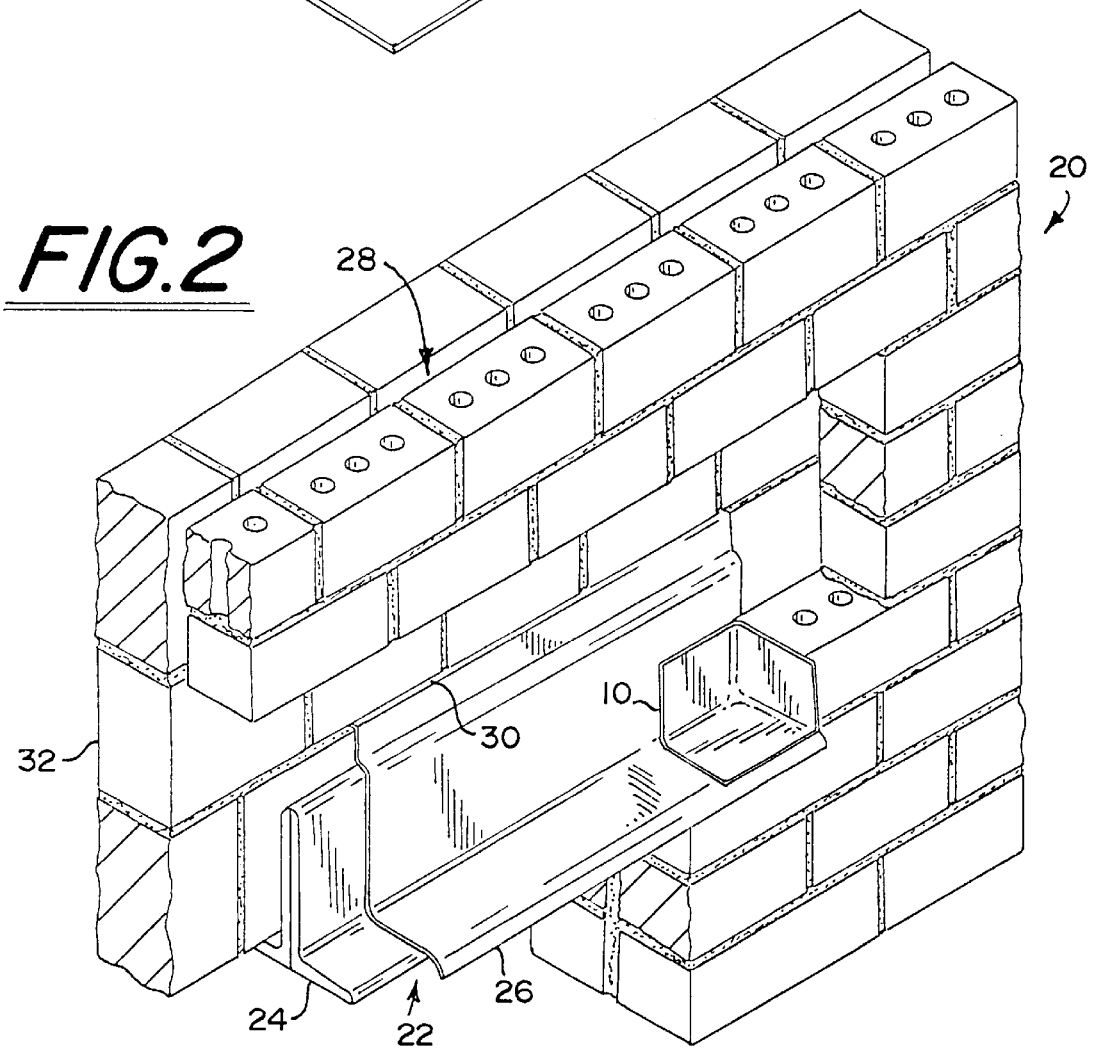
FIG. 2 is a perspective view of a masonry wall showing details of construction using the end dam of FIG. 1.

FIG. 2 shows details of the installation of an end dam 10 into a wall structure 20 above an existing opening 22 (e.g., door, window, etc). While FIG. 2 shows the application of the invention to an existing structure, it is noted that the invention is equally applicable to new construction.

As shown, four layers of existing brick is removed to a distance of 8 inches beyond either side of the opening 22. A flashing 26 is installed above the opening 22 along an upper surface of the lintel 24. The top edge 30 of the flashing 26 is inserted between the bricks along the top edge of the lintel 24. The flashing 26 may be attached by adhesive, mastic, etc.

To insert the top ,edge of the flashing 26 between the bricks, the mortar is first ground out. After inserting the flashing 26 between the bricks, the mortar is replaced to ensure a water tight seal between the flashing 26 and wall 20.

An end dam 10 is installed along each end of the flashing 26 (only one end shown in FIG. 2). The end dam 10 may be attached to the flashing 26 by adhesive disposed along a, single outside surface of the end dam 10 between the back surface of the end dam 10 and flashing 26, or adhesive may be applied to two or more sides of the outer surface 19. Following installation of the flashing 26 and end dams 10, the wall 20 may be completed in a normal manner.

Under the embodiment, the flashing 26 and end dam 10 together provide a continuous drainage system for moisture flowing downward within the drainage space 28 of the wall system 20. The flashing 26 intercepts moisture flowing vertically within the space 28 and directs such moisture to an exterior of the wall system 20 above the lintel 24. The end dam 10 cooperates with the flashing 26 to block water from flowing horizontally along a lower horizontal surface of the flashing 26 and re-entering the interior of the wall structure 20 along either side of the opening 22.

In another embodiment of the invention, a structure similar to the end dam 10 of FIG. 1 finds use as a corner flashing 50 (FIG. 4) on an inside corner in a masonry wall system where a wooden backing wall 52 meets a foundation

54. The use of a wooden backing wall 52 in some types of construction prevent the use of a top flange on corner flashing members, thereby requiring the use of a structure such as the corner flashing 50 shown in FIG. 4. The corner flashing 50 is generally constructed of an upright angled member having a bottom flange. As with the end dam 10, the corner flashing 50 functions to direct water from an inside of a masonry wall system to an exterior of such system.

Following installation of the corner flange 50 by nailing (or adhesive), the masonry wall may be completed by methods well known in the art. The masonry wall may be completed by placing masonry elements on top of the foundation and lower flange of the corner flashing 50, thereby encasing the corner flashing 50 within the wall between the backing wall 52 and masonry exterior.

In another embodiment of the invention, a corner flashing 56 (FIG. 3) is provided for exterior corners of masonry wall systems. As with the inside corner flashing 50, the outside corner flashing 56 may be used with wooden backing walls 52, adjacent to a foundation 54, to eliminate water from inside the wall system.

The outside corner flashing 56 has a similar construction to the inside corner flashing 50. The outside corner flashing generally has an upstanding vertical member with a horizontal flange generally extending around at least two outside surfaces of a lower edge.

A specific embodiment of novel methods and apparatus of ensuring proper drainage of masonry walls according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

I claim:

1. A masonry wall system having an inner vertical layer and an outer vertical layer, in intimate vertical association one to another, the masonry wall system comprising:

a lintel, over an opening of the wall system, supporting the inner and outer vertical layers in intimate vertical association on either side of a vertical rib extending longitudinally along an upper surface of the lintel;

a flashing extending longitudinally along an outer surface of the lintel, between the lintel and the supported outer vertical layer with an upper edge of the flashing penetrating a horizontal joint of the inner vertical layer above the rib of the lintel and a lower edge of the flashing extending out of the wall system above a lower edge of the lintel; and an end dam bonded to the flashing.

2. The masonry wall system as in claim 1 wherein the end dam further comprises plastic.

3. The masonry wall system as in claim 1 wherein the end dam further comprises rubberized asphalt.

* * * * *

UNITED STATES PATENT AND TRADEMARK OFFICE

CERTIFICATE OF CORRECTION

PATENT NO. : 5,815,986
DATED : Oct. 6, 1998
INVENTOR(S) : Laska

It is certified that error appears in the above-indentified patent and that said Letters Patent is hereby corrected as shown below:

In column 1, line 6, please delete "it", and insert therefor --a--.

In column 2, line 48, please delete the "," after "a".

Signed and Sealed this

Twenty-third Day of February, 1999

*Attest:*

Q. TODD DICKINSON

*Attesting Officer*

*Acting Commissioner of Patents and Trademarks*